United States Patent [19]

Fisher et al.

[11] 4,190,114

[45] Feb. 26, 1980

[54] SUBSEA WELLHEAD APPARATUS

[75] Inventors: Edmund A. Fisher; Frank P. Czerewaty, both of Houston, Tex.

[73] Assignee: Cameron Iron Works, Inc., Houston, Tex.

[21] Appl. No.: 934,687

[22] Filed: Aug. 18, 1978

[51] Int. Cl.[2] ..... E21B 7/12

[52] U.S. Cl. ..... 166/346; 166/75 R

[58] Field of Search ..... 166/338, 339, 343, 344, 166/346, 347, 351, 356, 362, 75 R, 334

[56] References Cited

U.S. PATENT DOCUMENTS

| | | | |
|---|---|---|---|
| 3,052,299 | 9/1962 | Geer et al. | 166/347 |
| 3,419,071 | 12/1968 | Williams, Jr. et al. | 166/346 |
| 3,473,605 | 10/1969 | Thuse et al. | 166/338 |
| 3,513,911 | 5/1970 | Petersen | 166/338 |
| 4,036,295 | 7/1977 | Kirkland et al. | 166/344 X |
| 4,067,202 | 1/1978 | Reed | 166/346 |

*Primary Examiner*—James A. Leppink
*Assistant Examiner*—Richard E. Favreau
*Attorney, Agent, or Firm*—Vinson & Elkins

[57] ABSTRACT

A subsea wellhead apparatus adapted to provide a connection from the wellhead to a subsea flowline, such apparatus including a christmas tree connected to the subsea wellhead near the sea floor, a pressure actuated connector having means for engaging a hub on the subsea flowline and by moving axially completing a connection from a flowline loop extending from the christmas tree to the connector to the subsea flowline, the loop being in a plane which is at a substantial angle to the axis of movement of the connector.

5 Claims, 2 Drawing Figures

SUBSEA WELLHEAD APPARATUS

BACKGROUND

The ability to provide a remotely actuated connection between a subsea wellhead and a subsea flowline has been advantageous in that it alleviates the necessity of providing divers for making such connections. In very deep water, the use of divers for making such connections has been avoided because of the limited depth tolerance of divers.

Remote connections of this type have been made previously. A typical example of such prior structure is disclosed in the L. E. Williams, Jr. et al U.S. Pat. No. 3,419,071 issued Dec. 31, 1958, and the L. E. Williams et al U.S. Pat. No. 3,481,396 issued Dec. 2, 1969, (subsequently reissued as U.S. Pat. No. Re. 27,340 on Apr. 25, 1972). In both of these patents a structure is disclosed which includes a loop connecting the christmas tree to a remotely actuated connector and the connector moves axially to connect to a hub on the end of a subsea flowline and such axial movement is along a line which lies substantially in the plane of the loop. Such movement causes a bending of the loop and generates substantial bending stresses therein. In both of these prior patents, the loop ends in a generally horizontal run which connects to the remotely actuated connector and the movement of the connector and the loop end is substantially in the plane of the loop.

SUMMARY

The present invention relates to an improved subsea wellhead apparatus for connecting the wellhead to a subsea flowline.

A flowline loop is used to connect from the christmas tree to a flowline on the sea floor through a sliding connector which moves the connecting end of the flowline loop to make the connection in a direction at an angle to the plane of the flowline loop. Thus, torsion is predominant in the loop rather than a direct bending as in prior art structures.

An object of the present invention is to provide an improved subsea wellhead apparatus for remotely connecting a wellhead through a flowline loop to a subsea flowline which exerts lower stress on the loop than the prior art.

Another object is to provide an improved subsea wellhead apparatus of the above type which requires less force to connect to a subsea flowline than prior art apparatus.

A further object is to provide an improved subsea wellhead apparatus of the above type in which lower reaction loads are exerted on the christmas tree in connecting to a subsea flowline than were encountered with the prior art.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
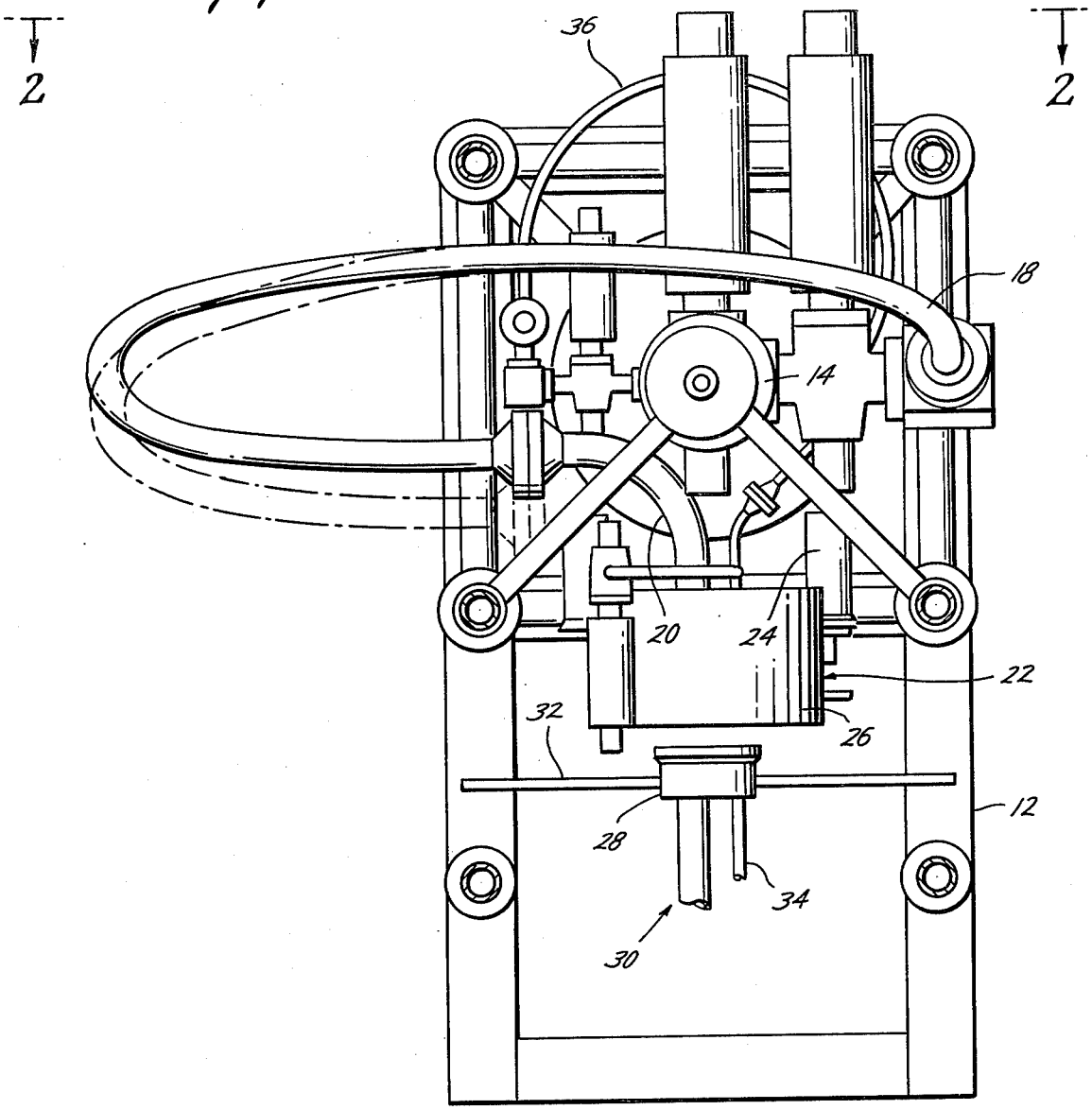
FIG. 1 is a plan view of the improved apparatus of the present invention with the unconnected position of the loop shown in solid line and the connected position shown in dashed lines.
Figure 2:
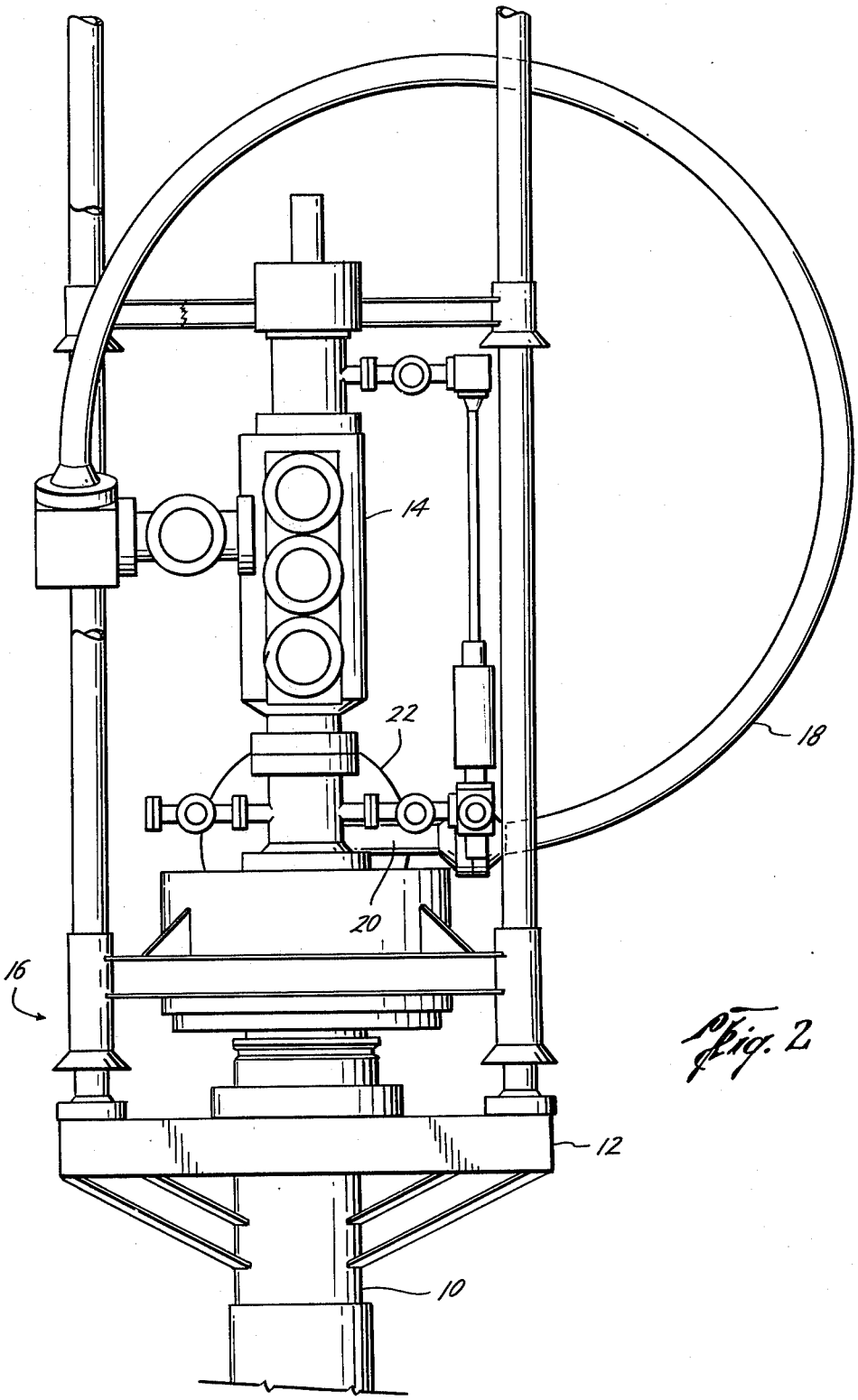
FIG. 2 is an end elevation view of the apparatus of FIG. 1 taken along line 2—2 in FIG. 1.

The improved apparatus is illustrated in FIGS. 1 and 2. The subsea wellhead 10 has the usual guide base 12 and a christmas tree 14 is secured to wellhead 10 by means 16. Loop 18 extends upwardly from its connection to christmas tree 14 and curves downward to elbow 20 which is secured to connector 22. The plane of the loop 18 lies at any angle to the axis of movement of connector 22. Connector 22 is actuated by actuating cylinder 24 and includes connecting means 26 to connect to hub 28 on the end of flowline 30. Hub 28 is supported from guide base 12 by bracket 32 to assure that hub 26 is retained in axial alignment with connector 22. Additional flowlines, such as 34, with loops, such as 36 may be accommodated in the same manner.

Extension of actuating cylinder 24 moves connector 22 and loop 18 to the position shown in dashed lines in FIG. 1. In this position, a positive, sealed connection is made by the connector 22 to the flowline 30. The deflection of loop 18 causes it to be subjected to torsional stress and relatively minor bending stress. However, such stresses are relatively low since the angle of twist is small and is taken over a long length of the loop 18.

This improved structure, by having the plane of the loop 18 positioned at an angle to the axis of the connecting movement, greatly reduces the stress in the loop 18 and also reduces the force or power required of actuating cylinder 24 to provide a completed connection to flowline 30. This also results in lower reaction loading of the loop 18 connection to the christmas tree 14. As can be seen particularly in FIG. 1, the plane of loop 18 is at a substantial angle, e.g., substantially perpendicular, to the axis of movement of connector 22. As this angle approaches zero, the stresses in the loop increase and the disadvantages of the prior art begin to appear since the loop movement changes from torsion to bending.

The improved apparatus of the present invention has application to those subsea wellheads which are not equipped for through-flowline pumping of tools and other devices and, with obvious modification, those which are so equipped.

What is claimed is:

1. An apparatus for connecting a subsea christmas tree to a subsea flowline, comprising
   - a production flowline loop connected to the christmas tree, and
   - a remotely actuated connector secured to the end of the flowline loop away from said tree,
   - said connector being movable in a line for engaging and connecting to a subsea flowline,
   - the movement of said connector moving the end of said loop secured to said connector along said line of movement,
   - said loop extending from said tree to said connector in a plane at a substantial angle to the line of movement of said connector whereby the movement of the connector end of said loop causes predominantly torsional stresses in said loop.

2. An apparatus for remotely connecting a subsea wellhead to a subsea production flowline, comprising
   - a christmas tree connected to said subsea wellhead,
   - a remotely actuated connector,
   - a flowline loop extending from said tree to said connector, and means on said subsea production flowline for engagement by said connector to provide a positive and complete flowline connection from said subsea wellhead through said christmas tree, flowline loop and connector to said subsea production flowline, said remotely actuated connector moving the connector end of said loop in a line for connecting to said subsea production flowline, the plane of said flowline loop being at a substantial angle to the line of movement of said connector whereby said loop is subjected to torsion and a relatively minor bending.

3. An apparatus according to claim 2 wherein the line of movement of said loop and said connector is substantially horizontal, and said loop lies in a plane substantially perpendicular to said line of movement.

4. An apparatus according to claim 2 including a base connected to said wellhead, a hub connected to said subsea production flowline, and means for supporting said hub from said base to assure that said hub is retained in axial alignment with said connector.

5. An apparatus according to claim 4, wherein said remotely actuated connector includes an actuating cylinder, and means for engaging said flowline hub.

* * * * *